US006824370B2

(12) United States Patent
Takatsu

(10) Patent No.: US 6,824,370 B2
(45) Date of Patent: Nov. 30, 2004

(54) ROTARY VANE GAS COMPRESSOR HAVING UNEQUAL INTERVALS BETWEEN VANE GROOVES AND/OR UNEQUAL DISTANCES BETWEEN VANE GROOVES AND ROTOR CENTER

(75) Inventor: Hidehisa Takatsu, Chiba (JP)

(73) Assignee: Calsonic Compressors Manufacturing Inc., Narashino (JP)

( * ) Notice: Subject to any disclaimer, the term of this patent is extended or adjusted under 35 U.S.C. 154(b) by 0 days.

(21) Appl. No.: 10/306,695

(22) Filed: Nov. 27, 2002

(65) Prior Publication Data

US 2003/0124014 A1 Jul. 3, 2003

(30) Foreign Application Priority Data

Nov. 30, 2001 (JP) ..... 2001-367563
Nov. 1, 2002 (JP) ..... 2002-319613

(51) Int. Cl.[7] ..... F04C 18/344
(52) U.S. Cl. ..... 418/236; 418/259
(58) Field of Search ..... 418/236, 238, 418/259

(56) References Cited

U.S. PATENT DOCUMENTS 2,068,918 A * 1/1937 Kagi ..... 418/236
4,619,595 A * 10/1986 Amano et al. ..... 418/259

FOREIGN PATENT DOCUMENTS

| | | |
|---|---|---|
| GB | 0421035 | 12/1934 |
| JP | 58217791 | 12/1983 |
| JP | 61241481 | 10/1986 |

* cited by examiner

*Primary Examiner*—John J. Vrablik
(74) *Attorney, Agent, or Firm*—Adams & Wilks

(57) ABSTRACT

Disclosed is a gas compressor capable of preventing generation of noise due to the vibration during the rotation of the rotor. A rotor rotating in a cylinder around a rotation shaft has five radially extending vane grooves, each of which supports a vane. The respective directions of the vane grooves are determined such that the respective angular differences between at least three adjacent compression chambers are not less than 5 degrees. Thus, the angular intervals in terms of direction between the vanes supported by the vane grooves are also different from each other. As a result, the timing with which the vanes pass the outlet port is irregular, and the discharge period is thus unequal between a plurality of compression chambers, whereby the periodicity of the vibration based thereon is reduced, and the peak values of the basic vibration component are reduced.

11 Claims, 10 Drawing Sheets

ROTARY VANE GAS COMPRESSOR HAVING UNEQUAL INTERVALS BETWEEN VANE GROOVES AND/OR UNEQUAL DISTANCES BETWEEN VANE GROOVES AND ROTOR CENTER

BACKGROUND OF THE INVENTION

1. Field of the Invention

The present invention relates to the construction of a rotary vane type gas compressor to be used in a vehicle air conditioner or the like.

2. Description of the Related Art

In a gas compressor used to compress the refrigerant of an air conditioner or the like, a rotor equipped with a plurality of vanes is rotatably provided in a cylinder which is arranged in a compressor case and whose inner peripheral surface is substantially elliptical, and, with its rotation, the space divided by the vanes forms compression chambers repeating a change in volume, refrigerant gas sucked into the compression chambers from an inlet port being compressed and discharged from an outlet port.

FIG. 8 is a longitudinal sectional view of such a conventional gas compressor, and FIG. 9 is a sectional view taken along line 9—9 of FIG. 8.

A compressor case 10 is formed by a housing 11 open at one end and a front head 12 mounted to the open side thereof. In the housing 11, a cylinder 40 with a substantially elliptical inner periphery is arranged between a front side block 20 and a rear side block 30, and a rotor 50 equipped with a plurality of vanes is rotatably provided inside the cylinder 40.

A rotation shaft 51 rotating integrally with the rotor 50 extends through the front side block 20. Its forward end portion extends outwards from a lip seal 18 at an end wall of the compressor case, and its rear end portion is supported by the rear side block 30. An electromagnetic clutch 25 having a pulley 24 is mounted to the forward end of the rotation shaft, and torque from a crank pulley of an engine (not shown) is received.

As shown in FIG. 9, in particular, the rotor 50 has around the rotor rotation shaft 51 a plurality of radially extending vane grooves 53 arranged circumferentially at equal intervals, with vanes 58 being slidably attached thereto. During the rotation of the rotor 50, the vanes 58 are urged toward the inner peripheral surface of the cylinder 40 by the centrifugal force and the hydraulic pressure applied to the bottoms of the vane grooves 53. The interior of the cylinder 40 is divided into a plurality of small chambers by the rotor 50 and the vanes 58, forming compression chambers 48 repeating changes in volume as the rotor 50 rotates.

Formed between the front head 12 and the front side block 20 is a front side suction chamber 13 equipped with a refrigerant gas suction port 14.

The front side block 20 has an inlet port 22 establishing communication between the front side suction chamber 13 and the compression chambers 48.

Formed between the closed side of the housing 11 and the rear side block 30 is a discharge chamber 15 equipped with a refrigerant gas discharge port 16.

The cylinder 40 has, in its outer periphery and near the shorter diameter portion, discharge chambers 44 in the form of cutouts, and the corresponding portions of the cylinder constitute thin-walled portions. Outlet ports 42 are provided in these thin-walled portions. The outlet ports 42 are equipped with reed valves 43.

The refrigerant gas discharged from the outlet ports 42 is discharged into the discharge chamber 15 by way of the discharge chambers 44 and an oil separator 38.

The inlet ports 22 and the outlet ports 42 are respectively provided at two positions along the periphery of the cylinder so as to be symmetrical with respect to the rotation axis of the rotor.

When the rotor 50 rotates, the refrigerant gas flowing into the gas suction port 14 flows by way of the front side suction chamber 13 and the inlet ports 22 before it is sucked into the compression chambers 48. And, after being compressed in the compression chambers 48, it is discharged from the outlet ports 42 and flows by way of the discharge chamber 15 before it is supplied to the exterior through the refrigerant gas discharge port 16.

In such a conventional gas compressor, vibration is generated in the driving state in which the rotor 50 is rotated, and this vibration is often propagated to peripheral equipment including piping leading to an evaporator or a condenser connected to the gas compressor, thereby generating noise. FIG. 10 shows raw data obtained through measurement during operation of a conventional gas compressor, showing how the gas compressor generates a vibration acceleration component.

In FIG. 10, the horizontal axis indicates time and is graduated to 10 ms, and the vertical axis indicates acceleration and is graduated to 20 $m/s^2$. In the vibration acceleration measurement, an acceleration sensor was fixed to the mounting portion of the compressor for a vehicle (as indicated by the shaded portion of FIG. 8) so that the acceleration sensor is positioned close to the vehicle, and the acceleration component in the direction of the rotation axis of the gas compressor was detected. The rotating speed of the gas compressor was set to approximately 1190 rpm on the assumption that the engine idling speed was transmitted.

From this raw data, it can be seen that a vibration acceleration of an amplification of approximately 80 $m/s^2$ is generated at an equal interval of approximately 5 ms. When heard at the time of measurement, it is felt as a noise of a frequency of approximately 200 Hz.

Upon examination of the cause of the vibration, frequency analysis of the vibration waveform indicated appearance of very conspicuous peaks in the vibration of the basic compression (discharge) component of the gas compressor, and it was found out that this resonated with the peripheral equipment to thereby cause noise.

More specifically, in a gas compressor with five vanes, which has two outlet ports, compressed refrigerant is discharged ten times in one rotation of the rotor, and the resultant vibration constituting the basic component is obtained by multiplying the rotating speed of the rotor by ten.

SUMMARY OF THE INVENTION

In view of the above problem, it is accordingly an object of the present invention to provide a gas compressor which prevents a vibration with conspicuous peaks from being generated at minute equal time intervals during rotation of the rotor, thereby preventing generation of noise.

Since the basic component of the vibration generating peaks is consistently proportional to the rotating speed of the rotor, it is possible to restrain generation of peaks by destroying this consistency. Thus, in a first aspect of the present invention, there is provided a gas compressor of the type in which a rotor supporting a plurality of vanes in individual vane grooves is rotatably provided in a cylinder with a substantially elliptical inner peripheral surface arranged in a compressor case, the spaces obtained through division by the vanes serving as compression chambers, and the gas compressed in the compression chambers being discharged from an outlet port formed in the side wall of the cylinder to a discharge chamber outside the cylinder, wherein the openings of the vane grooves are arranged circumferentially at unequal intervals on the outer peripheral surface of the rotor.

In a second aspect of the invention, to arrange the openings of the vane grooves at unequal intervals, the directions of the vane grooves are determined such that they are at unequal angular intervals.

In this regard, according to a third aspect of the invention, it is possible to keep constant the distance between the center lines of the plurality of vane grooves and the rotor center.

In a fourth aspect of the invention, the distances between the respective center lines of the plurality of vane grooves and the rotor center are made unequal to each other.

In this regard, according to a fifth aspect of the invention, it is possible to determine the respective directions of the plurality of vane grooves such that they are arranged at equal angular intervals.

In a sixth aspect of the invention, the number of vane grooves is five, and the respective directions of the vane grooves are determined such that the respective angular differences between at least three adjacent compression chambers are not less than 5 degrees.

And, in a seventh aspect of the invention, the angular interval between the vane groove directions is set so as to range from 50 to 120 degrees.

DESCRIPTION OF THE PREFERRED EMBODIMENTS

Embodiments of the present invention will now be described.

Figure 1:
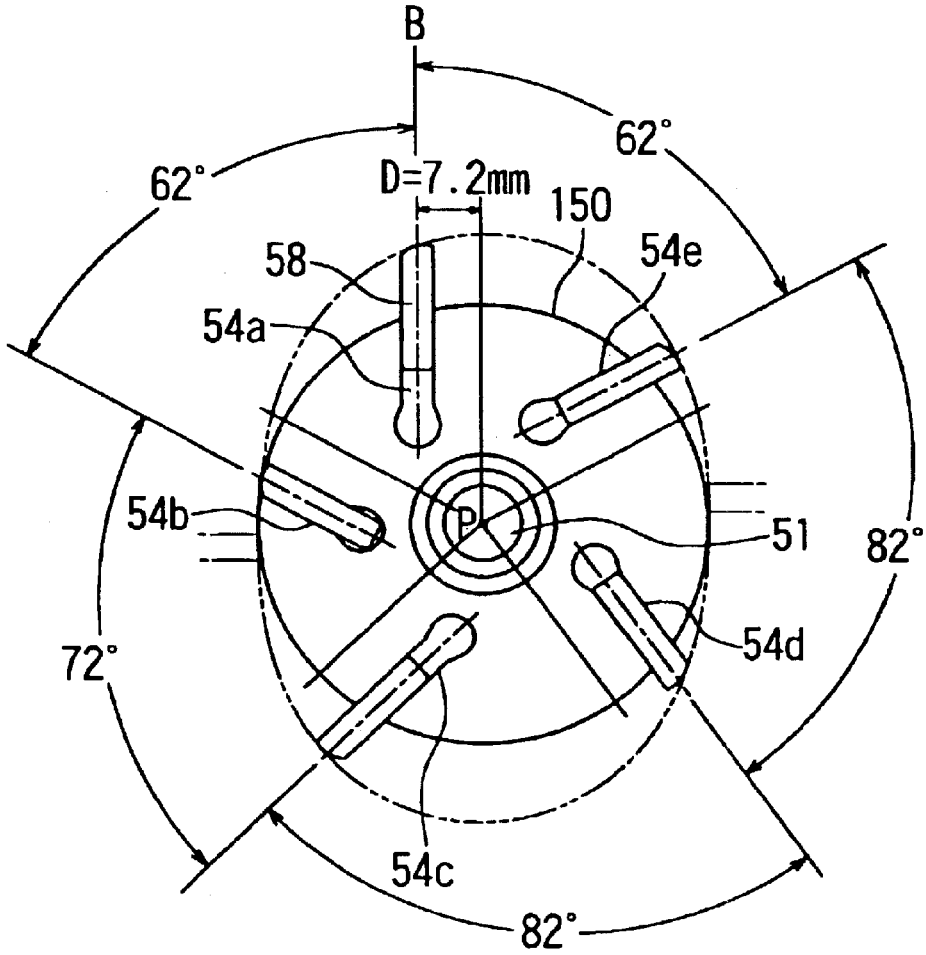
FIG. 1 is a sectional view of the rotor and vanes of a gas compressor according to a first embodiment of the present invention.
Figure 9:
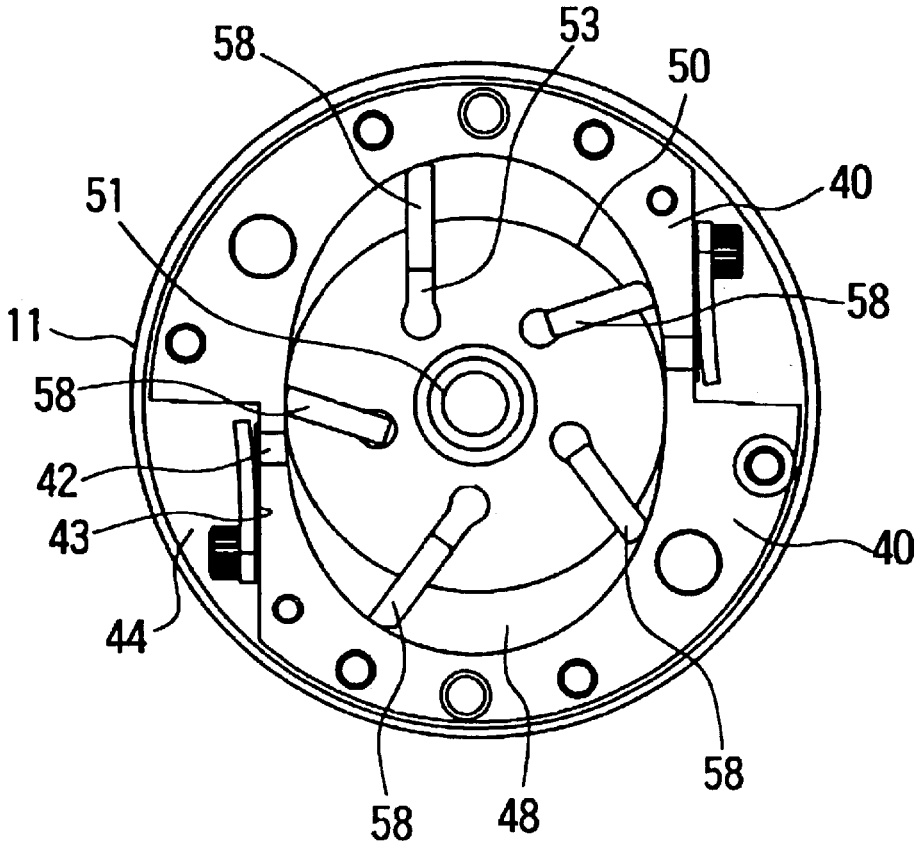
FIG. 9 PRIOR ART
FIG. 9 is a sectional view of the conventional gas compressor, taken along line 9—9 of FIG. 8.

FIG. 1 is a sectional view corresponding to FIG. 9, showing the rotor and vanes of a gas compressor according to a first embodiment of the invention.

A rotor 150 rotating inside a cylinder 40 around a rotation shaft 51 has a diameter of 50 mm and five radially extending vane grooves 54 (54*a*, 54*b*, 54*c*, 54*d*, and 54*e*) which are open in the peripheral surface thereof, with vanes 58 being supported by the vane grooves.

In the rotor 150, the respective angular intervals between the adjacent vane grooves 54 are different from each other: The interval between the vane grooves 54*a* and 54*b* is 62 degrees, the interval between the vane grooves 54*b* and 54*c* is 72 degrees, the interval between the vane grooves 54*c* and 54*d* is 82 degrees, the interval between the vane grooves 54*d* and 54*e* is 82 degrees, and the interval between the vane grooves 54*e* and 54*a* is 62 degrees. Thus, the directions of the vanes 58 supported by these vane grooves are respectively determined as follows: 62 degrees, 72 degrees, 82 degrees, 82 degrees, and 62 degrees.

The distance D between the center line B of each vane groove 54 and the rotor center P is a fixed value of 7.2 mm.

Figure 8:
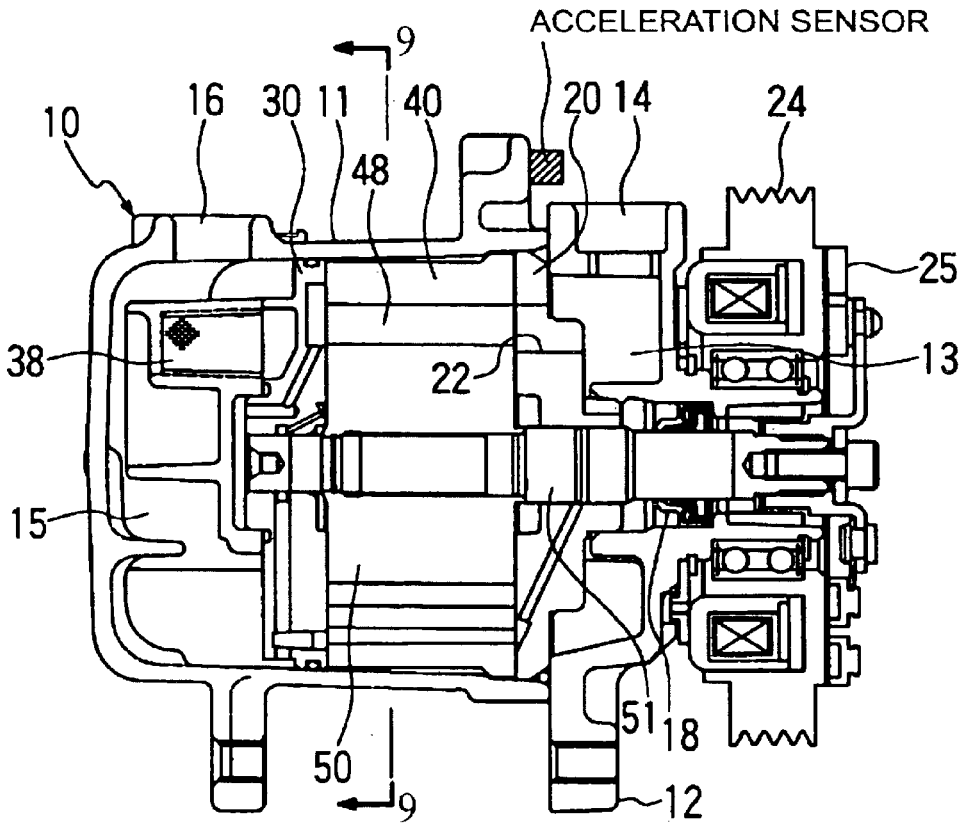
FIG. 8 PRIOR ART
FIG. 8 is a longitudinal sectional view of a conventional gas compressor.

Otherwise, this embodiment is of the same construction as that shown in FIGS. 8 and 9.

In this embodiment, constructed as described above, the circumferential intervals between the plurality of vanes 58 supported by the rotor 150 are not equal, but different from each other, so that the timing with which the vanes 58 pass the outlet ports 42 is irregular. That is, the time interval between discharge completion in one compression chamber and discharge completion in the next compression chamber is short between two compression chambers arranged at a small vane interval and large between two compression chambers arranged at a a large vane interval. Further, among the five compression chambers described above there are three sets of adjacent chambers having angular differences therebetween, respectively. This causes three time interval changes in one rotational cycle of the rotor.

In this way, the discharge periods of the plurality of compression chambers are different from each other, so that the vibration period based thereon is also irregular. Thus, the periodicity deteriorates, with the result that the peak value in the basic component based on the rotation is reduced, so that it is possible to prevent generation of noise due to propagation of vibration to other vehicle-mounted equipment, etc.

While in the embodiment shown the smaller vane interval is set to 62 degrees and the larger one is set to 82 degrees, it is possible to set the intervals appropriately within the range of 50 to 120 degrees in the case in which there are five vanes 58. And, it is possible to obtain the same effect as described above even if the intervals between the adjacent vanes are different from the above ones as long as the respective angular differences between at least three adjacent compression chambers formed between the vanes are not less than 5 degrees.

That is, in the rotor 150, the difference between the interval between the vane grooves 54*a* and 54*b* and the interval between the vane grooves 54*b* and 54*c* is 72 degrees−62 degrees=10 degrees, the difference between the interval between the vane grooves 54*b* and 54*c* and the interval between the vane grooves 54*c* and 54*d* is 82 degrees−72 degrees=10 degrees, and the difference between the interval between the vane grooves 54*d* and 54*e* and the interval between the vane grooves 54*e* and 54*a* is 82 degrees−62 degrees=20 degrees.

Figure 2:
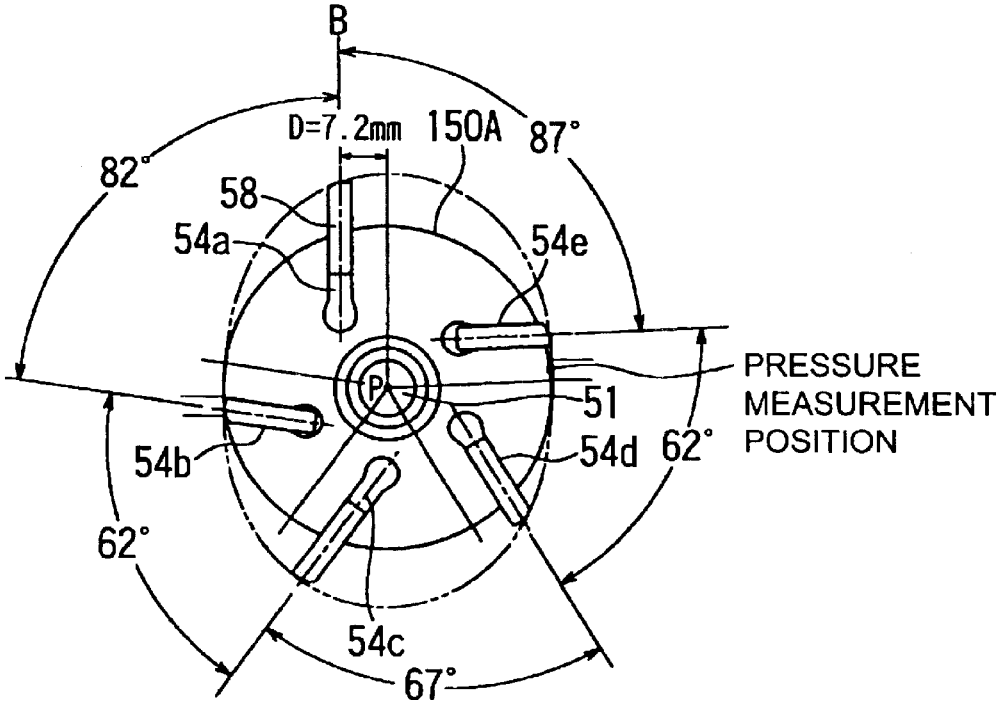
FIG. 2 is a sectional view of the rotor and vanes of a modification of the first embodiment shown in FIG. 1.
Figure 3:
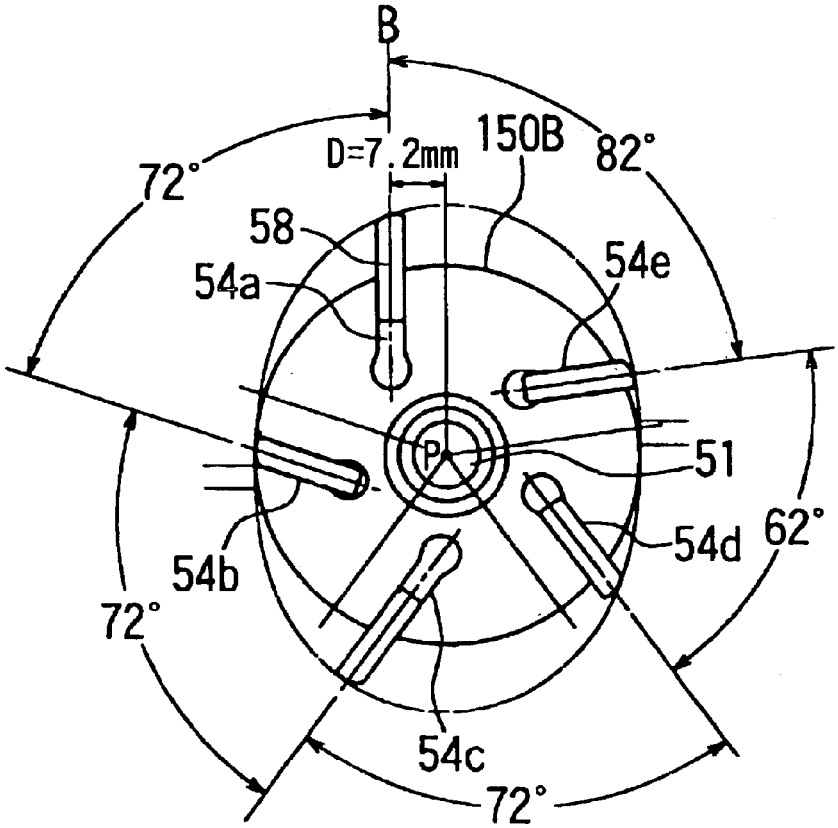
FIG. 3 is a sectional view of the rotor and vanes of another modification of the first embodiment shown in FIG. 1.
Figure 4:
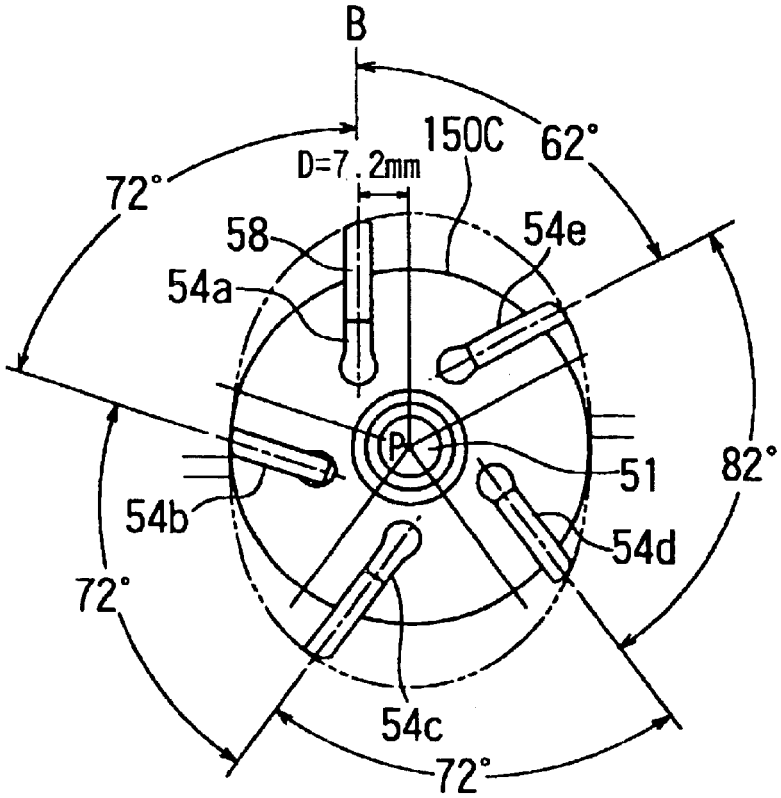
FIG. 4 is a sectional view of the rotor and vanes of still another modification of the first embodiment shown in FIG. 1.

FIGS. 2 through 4 show other examples in which the angular difference between the compression chambers is not less than 5 degrees.

In the rotor 150A shown in FIG. 2, the angular interval between the vane grooves 54*a* and 54*b* is 82 degrees, the angular interval between the vane grooves 54*b* and 54*c* is 62 degrees, the angular interval between the vane grooves 54*c* and 54*d* is 67 degrees, the angular interval between the vane grooves 54*d* and 54*e* is 62 degrees, and the angular interval between the vane grooves 54*e* and 54*a* is 87 degrees. Thus, the respective directions of the vanes 58 supported by the vane grooves are: 82 degrees, 62 degrees, 67 degrees, 62 degrees, and 87 degrees. The angular differences between all the adjacent compression chambers are not less than 5 degrees (20 degrees, 5 degrees, 5 degrees, 25 degrees, and 5 degrees). Otherwise, this construction is the same as that shown in FIG. 1.

In the rotor 150B shown in FIG. 3, the angular interval between the vane grooves 54*a* and 54*b* is 72 degrees, the angular interval between the vane grooves 54*b* and 54*c* is 72 degrees, the angular interval between the vane grooves 54*c* and 54*d* is 72 degrees, the angular interval between the vane grooves 54*d* and 54*e* is 62 degrees, and the angular interval between the vane grooves 54*e* and 54*a* is 82 degrees. Thus, the respective directions of the vanes 58 supported by the vane grooves are at angular intervals of: 72 degrees, 72 degrees, 72 degrees, 62 degrees, and 82 degrees. Among the five compression chambers described above there are three sets of adjacent chambers having angular differences not less than 5 degrees (10 degrees, 20 degrees, and 10 degrees) therebetween, respectively. Otherwise, this construction is the same as that shown in FIG. 1.

In the rotor 150C shown in FIG. 4, the angular interval between the vane grooves 54*a* and 54*b* is 72 degrees, the angular interval between the vane grooves 54*b* and 54*c* is 72 degrees, the angular interval between the vane grooves 54*c* and 54*d* is 72 degrees, the angular interval between the vane grooves 54*d* and 54*e* is 82 degrees, and the angular interval between the vane grooves 54*e* and 54*a* is 62 degrees. Thus, the respective directions of the vanes 58 supported by the vane grooves are at angular intervals of: 72 degrees, 72 degrees, 72 degrees, 82 degrees, and 62 degrees. Among the five compression chambers described above there are three sets of adjacent chambers having angular differences not less than 5 degrees (10 decgrees, 20 degrees, and 10 degrees) therebetween, respectively. Otherwise, this construction is the same as that shown in FIG. 1.

Figure 5:
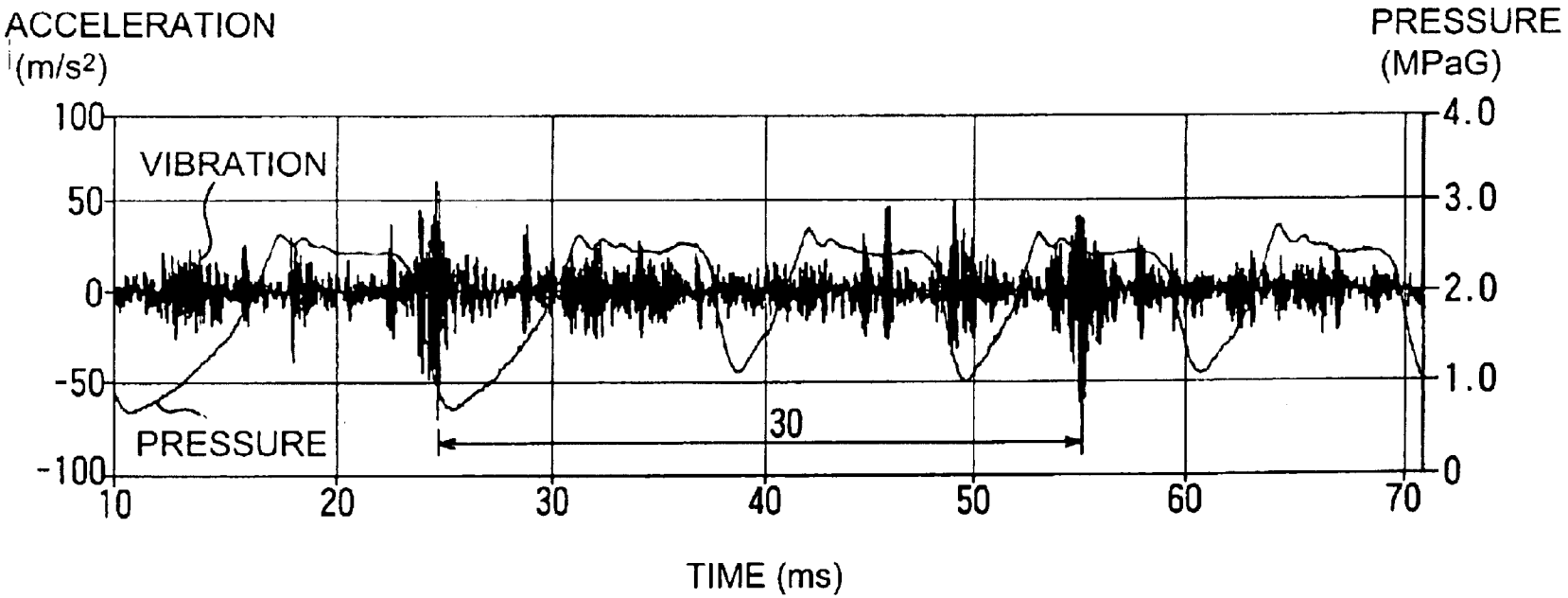
FIG. 5 is a diagram showing the vibration acceleration measurement results of a gas compressor according to the present invention.

FIG. 5 shows raw data on the result of measurement performed on a compressor using the rotor 150A, with the vibration acceleration component superimposed on the pressure of the compressed high pressure refrigerant gas.

In FIG. 5, the horizontal axis indicates time and is graduated to 10 ms, and the vertical axis indicates acceleration and pressure and is graduated to 20 $m/s^2$ and 1.0 MPa. In measuring the vibration acceleration, an acceleration sensor was fixed to the portion of the compressor which is mounted to the vehicle so that it is situated close to the vehicle (as indicated by the shaded portion of FIG. 8), and the acceleration component in the direction of the rotation shaft of the gas compressor was detected.

Figure 10:
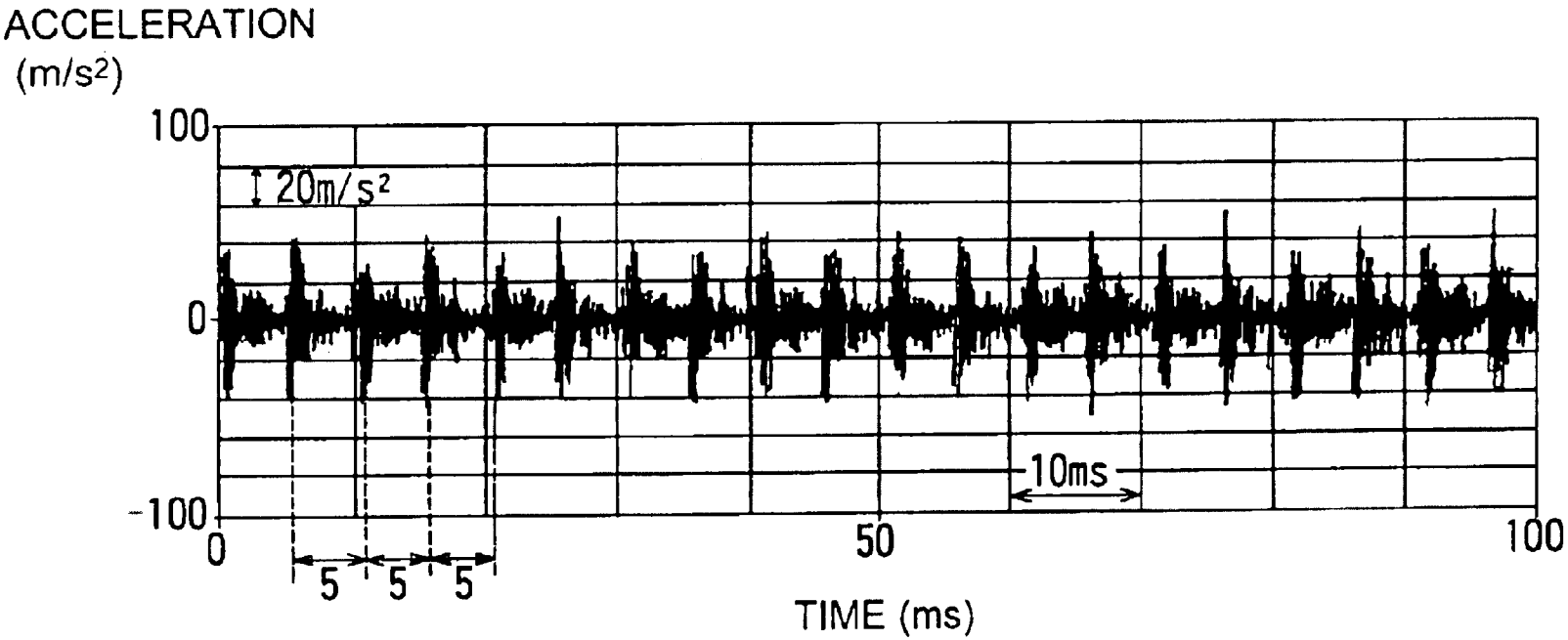
FIG. 10 PRIOR ART
FIG. 10 is a diagram showing the vibration acceleration measurement results of the conventional gas compressor.

The gas compressor rotating speed was set to approximately 900 rpm on the assumption that the idling speed of the engine is transmitted. The reason for reducing the RPM by approximately 200 rpm as compared with the measurement of FIG. 10 is that, as is empirically known, the lower the speed and the higher the pressure, the easier the generation of vibration, and that it is easier to see whether there are vibration peaks at equal intervals. Thus, the total length of the horizontal axis of this data substantially corresponds to one rotation of the compressor. The pressure measurement of the compressed high pressure refrigerant gas was performed by arranging a small pressure sensor on the rear side block 30 at a position shown in FIG. 2 where the compression chamber volume is substantially minimum. Thus, the measurement is performed at only one of the two outlet ports, so that one rotation of the rotor is detected as five pressure fluctuations.

It can be seen that in the five pressure fluctuations, the low pressure portion at approximately 11 ms (approximately 0.7 MPaG) and the low pressure portion at approximately 26 ms (approximately 0.7 MPaG) are lower by approximately 0.3 to 0.4 MPa as compared with the other low pressure portions at approximately 38 ms, 49 ms, and 61 ms. This is because the compression chamber volume in the compression from the portion at approximately 11 ms to the portion at approximately 26 ms and the compression chamber volume in the compression from the portion at approximately 26 ms to the portion at approximately 38 ms are larger than the compression chamber volume in the other compressions. In the embodiment used in this pressure measurement, shown in FIG. 2, the angle between the vanes 58 supported by the vane grooves 54*e* and 54*a* is 87 degrees, and the angle between the vanes 58 supported by the vane grooves 54*a* and 54*b* is 82 degrees, and the volumes of these two compression chambers are larger than the volumes of the other three compression chambers. It can be presumed from this that at the time of the portion at approximately 11 ms shown in FIG. 5, the vane 58 supported by the vane groove 54*e* passes the outlet port portion at the pressure measurement position, and that at the time of the portion at approximately 26 ms, the vane 58 supported by the vane groove 54*a* passes the outlet port portion at the pressure measurement position. When the volume of the compression chamber for next discharge immediately after the vane 58 has passed the outlet port portion is large, it means that the compression has not progressed yet by the volume ratio, so that the pressure as measured is low.

In this way, a plurality of vane grooves 54 for supporting the vanes 58 are arranged at unequal angular intervals, whereby the volumes of the compression chambers formed between the individual vanes are different from each other, and the volumes of gas sucked into the compression chambers are also different from each other. However, the volume of gas sucked in by one rotation of the rotor is the same as that in the conventional compressor in which the vane grooves 54 are arranged at equal intervals, and the discharge amount is also the same. Assuming that the compression chamber volume when the angular interval between the adjacent vane grooves 54 is 72 degrees is 1, the compression chamber volume is: approximately 0.88 when the angular interval is 62 degrees; approximately 0.95 when the angular interval is 67 degrees; approximately 1.05 when the angular interval is 77 degrees; approximately 1.09 when the angular interval is 82 degrees; and approximately 1.12 when the angular interval is 87 degrees.

It can be seen that the chart of FIG. 5 showing vibration acceleration indicates first that no such regular vibration acceleration of a minute time interval of 5 ms as in the prior art shown in FIG. 10 is generated. It is to be noted, however, that a conspicuous peak of an amplitude of approximately 130 $m/s^2$ is generated near the point in time of 25 ms, and then a conspicuous peak of an amplitude of approximately 115 $m/s^2$ is generated near the point in time of 55 ms which is approximately 30 ms after that. It is to be presumed that these two conspicuous peaks appearing in one rotation of the rotor will be continuously generated from the second rotation onward. However, if large in amplitude, the vibration has a low frequency of approximately 33 Hz. Further, even if the compressor RPM is increased by 200 rpm, the frequency is as low as approximately 40 Hz. In the case of such a low frequency vibration, the resonance frequency with respect to the vehicle is also low, and is in the range where practically no person perceives it as vibration or noise. Thus, the vibration and noise that can be perceived by human beings in an actual vehicle is reduced.

The rotors 150B and 150C provide a similar vibration reducing effect.

Figure 6:
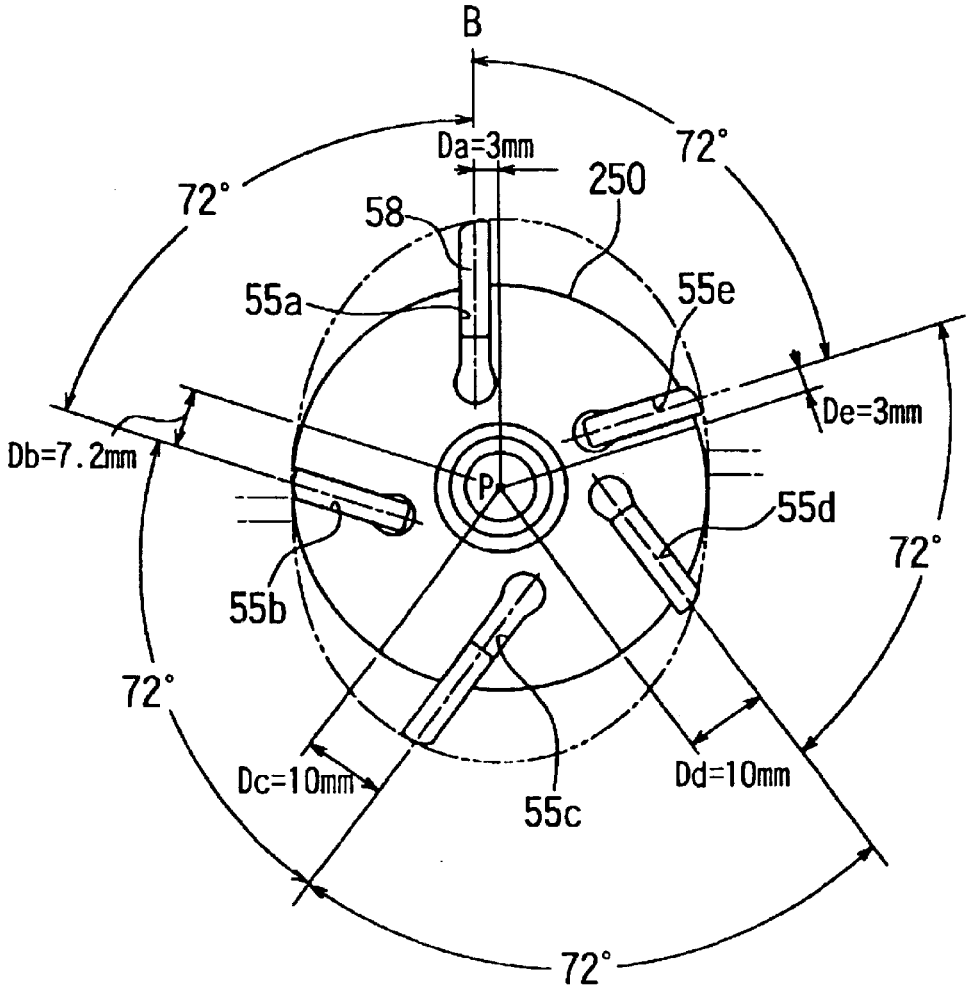
FIG. 6 is a sectional view of the rotor and vanes of a gas compressor according to a second embodiment of the present invention.

Next, FIG. 6 shows a second embodiment of the present invention.

This embodiment is provided with a rotor 250 in which the vane grooves 55 are arranged at a fixed interval in terms of direction and in which the distances D between the center lines B of the vane grooves 55 and the rotor center are different between the adjacent vane grooves.

That is, the five adjacent vane grooves 55 (55*a*, 55*b*, 55*c*, 55*d*, and 55*e*) are deviated from each other in terms of direction by an equal angle of 72 degrees. Regarding the distances between the center lines B of the vane grooves 55 and the rotor center P, they are as follows: the distance Da in the case of the vane groove 55*a* is 3 mm, the distance Db in the case of the vane groove 55*b* is 7.2 mm, the distance Dc in the case of the vane groove 55*c* is 10 mm, the distance Dd in the case of the vane groove 55*d* is 10 mm, and the distance De in the case of the vane groove 55*e* is 3 mm.

Due to this arrangement, despite the fact that the inclination angles of the vane grooves 55 are the same, the openings of the vane grooves 55 in the outer peripheral surface of the rotor 250 are arranged circumferentially at unequal intervals as in the first embodiment.

Thus, the timing with which the vanes 58 supported by the vane grooves 55 pass the outlet ports 42 is irregular, so that the discharge period is different between the plurality of compression chambers. Thus, the period of the vibration base thereon is also irregular. As a result, it is possible to obtain a noise preventing effect as in the first embodiment.

In this case also, the distances Da through De between the center lines B of the vane grooves 55 and the rotor center P are not restricted to those of the above example. They can be set arbitrarily as long as the openings of the vane grooves 55 in the outer peripheral surface of the rotor 250 are arranged at unequal intervals.

Further, it is also possible to combine the first embodiment, in which the vanes are arranged circumferentially at unequal intervals, with the second embodiment, in which the distances between center lines of the vane grooves and the rotor center are different from each other.

Figure 7:
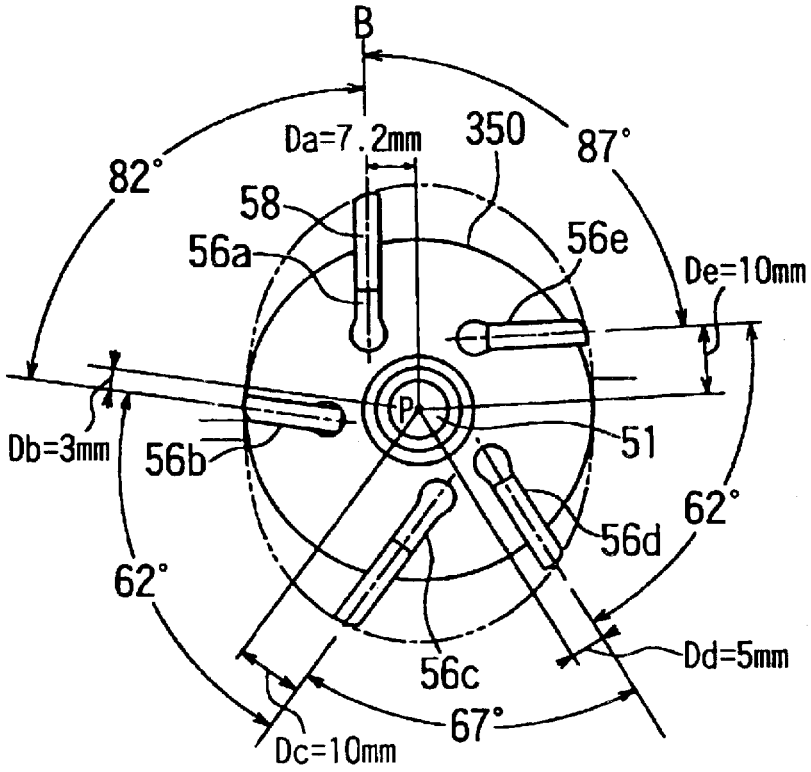
FIG. 7 is a sectional view of a rotor and vanes, showing an example of a combination of the first and second embodiments of the gas compressor of the present invention.

FIG. 7 shows an example of such a combination. In a rotor 350, the angular interval between the vane grooves 56*a* and 56*b* is 82 degrees, the angular interval between the vane grooves 56*b* and 56*c* is 62 degrees, the angular interval between the vane grooves 56*c* and 56*d* is 67 degrees, the angular interval between the vane grooves 56*d* and 56*e* is 62 degrees, and the angular interval between the vane grooves 56*e* and 56*a* is 87 degrees. Thus, the angular intervals in terms of direction of the vanes 58 supported by these vane grooves are as follows: 82 degrees, 62 degrees, 67 degrees, 62 degrees, and 87 degrees. Further, the angular differences between all the adjacent compression chambers are not less than 5 degrees (20 degrees, 5 degrees, 5 degrees, 25 degrees, and 5 degrees).

Furthermore, the distances between the center lines B of the vane grooves 56 and the rotor center P are as follows: the distance Da in the case of the vane groove 56*a* is 7.2 mm, the distance Db in the case of the vane groove 56*b* is 3 mm, the distance Dc in the case of the vane groove 56*c* is 10 mm, the distance Dd in the case of the vane groove 56*d* is 5 mm, and the distance De in the case of the vane groove 56*e* is 10 mm.

In this arrangement also, the discharge period is unequal between the plurality of compression chambers, whereby it is possible to obtain a noise preventing effect.

As described above, in accordance with the present invention, there is provided a rotary vane type gas compressor in which the openings of the vane grooves supporting a plurality of vanes are arranged circumferentially at unequal intervals on the outer peripheral surface of the rotor, whereby the timing with which the vanes pass the outlet ports is irregular, and thus the discharge period is unequal, so that the periodicity of the vibration is reduced, thereby preventing generation of noise.

The openings of the vane grooves are arranged at unequal intervals by making the angular intervals in terms of direction between the vane grooves unequal, or by making the distances between the center lines of the vane grooves and the rotor center different from each other, or by combining these arrangements. In any case, such an irregular arrangement can be easily realized solely by changing the setting of the vane grooves.

What is claimed is:

1. A gas compressor comprising:

a compressor case;

a cylinder disposed in the compressor case and having an elliptical inner peripheral surface;

a rotor rotatably disposed in the cylinder;

a plurality of vane grooves arranged on the outer peripheral surface of the rotor at circumferentially spaced angular intervals, the distances between respective center lines of the plurality of vane grooves and the rotor center being unequal to each other, and the plurality of vane grooves being circumferentially spaced at equal angular intervals;

a plurality of vanes slidably disposed in respective vane grooves;

compression chambers divided and formed by the cylinder, the rotor, and the vanes; and an outlet port formed in a side wall of the cylinder and through which gas compressed in the compression chambers is discharged.

2. A gas compressor comprising:

a compressor case:

a cylinder disposed in the compressor case and having a generally elliptical inner peripheral surface;

a rotationally driven rotor rotatably disposed in the cylinder;

plural vane grooves formed in the rotor and extending inwardly along respective center lines from an outer peripheral surface of the rotor, wherein the center lines of at least some of the vane grooves are circumferentially spaced on the outer peripheral surface from the center lines of adjacent vane grooves at unequal angular intervals within the range of 50°–120°, the center lines of four successive vane grooves define three successive angular intervals, each two adjacent angular intervals of the three successive angular intervals differ by not less than 5°, and the distances. between the respective center lines of said four successive vane grooves and the rotor center are equal to each other; and plural vanes slidably disposed in respective ones of the vane grooves and cooperating with the inner peripheral surface of the compressor case and the outer peripheral surface of the rotor to define plural compression chambers for intaking a gas, compressing the gas and discharging compressed gas during rotation of the rotor.

3. A gas compressor according to claim 2; wherein the plurality of vane grooves consists of five vane grooves.

4. A gas compressor comprising:

a compressor case;

a cylinder disposed in the compressor case and having a generally elliptical inner peripheral surface;

a rotationally driven rotor rotatably disposed in the cylinder;

plural vane grooves formed in the rotor and extending inwardly along respective center lines from an outer peripheral surface of the rotor, wherein the center lines of at least some of the vane grooves are circumferentially spaced on the outer peripheral surface from the center lines of adjacent vane grooves at unequal angular intervals within the range of 50°–120°, the center lines of all of the vane grooves are circumferentially spaced on the outer peripheral surface from the center lines of adjacent vane grooves at unequal angular intervals within the range of 50°–120°, and the distances between the respective center lines of all of the vane grooves and the rotor center are equal to each other; and plural vanes slidably disposed in respective ones of the vane grooves and cooperating with the inner peripheral surface of the compressor case and the outer peripheral surface of the rotor to define plural compression chambers for intaking a gas, compressing the gas and discharging compressed gas during rotation of the rotor.

5. A gas compressor according to claim 4; wherein the plurality of vane grooves consists of five vane grooves.

6. A gas compressor comprising:

a compressor case;

a cylinder disposed in the compressor case and having a generally elliptical inner peripheral surface;

a rotationally driven rotor rotatably disposed in the cylinder;

plural vane grooves formed in the rotor and extending inwardly along respective center lines from an outer peripheral surface of the rotor, wherein the center lines of at least some of the vane grooves are circumferentially spaced on the outer peripheral surface from the center lines of adjacent vane grooves at unequal angular intervals within the range of 50°–120°, the center lines of three of the vanes grooves are circumferentially spaced on the outer peripheral surface from the center lines of adjacent vane grooves at unequal angular intervals within the range of 50°–120°, and the distance between the respective center lines of said three vane grooves and the rotor center are equal to each other; and plural vanes slidably disposed in respective ones of the vane grooves and cooperating with the inner peripheral surface of the compressor case and the outer peripheral surface of the rotor to define plural compression chambers for intaking a gas, compressing the gas and discharging compressed gas during rotation of the rotor.

7. A gas compressor according to claim 6; wherein the plurality of vane grooves consists of five vane grooves.

8. A gas compressor comprising:

a compressor case;

a cylinder disposed in the compressor case and having a generally elliptical inner peripheral surface;

a rotationally driven rotor rotatably disposed in the cylinder;

plural vane grooves formed in the rotor and extending inwardly along respective center lines from an outer peripheral surface of the rotor, the center lines of all of the vane grooves being circumferentially spaced on the outer peripheral surface from the center lines of adjacent vane grooves at equal angular intervals, and the distances between respective center lines of some of the vane grooves and the rotor center being unequal to each other; and plural vanes slidably disposed in respective vane grooves and cooperating with the inner peripheral surface of the compressor case and the outer peripheral surface of the rotor to define plural compression chambers for intaking a gas, compressing the gas and discharging compressed gas during rotation of the rotor.

9. A gas compressor according to claim 8; wherein the distance between respective center lines of two adjacent vane grooves and the rotor center are equal to each other.

10. A gas compressor according to claim 8; wherein the distances between respective center lines of a first pair of adjacent vane grooves and the rotor center are equal to each other, and the distances between respective center lines of a second pair of adjacent vane grooves and the rotor center are equal to each other but different from those of the first pair.

11. A gas compressor according to claim 8; wherein the plurality of vane grooves consists of five vane grooves.

* * * * *